US007517239B1

(12) United States Patent
Ju

(10) Patent No.: US 7,517,239 B1
(45) Date of Patent: Apr. 14, 2009

(54) ELECTRICAL CONNECTOR

(75) Inventor: Ted Ju, Keelung (TW)

(73) Assignee: Lotes Co., Ltd., Anloku Keelung (TW)

( * ) Notice: Subject to any disclaimer, the term of this patent is extended or adjusted under 35 U.S.C. 154(b) by 0 days.

(21) Appl. No.: 12/130,154

(22) Filed: May 30, 2008

(30) Foreign Application Priority Data

Oct. 9, 2007 (CN) ..... 2007 2 0058056

(51) Int. Cl.
*H01R 13/62* (2006.01)

(52) U.S. Cl. ..... 439/159

(58) Field of Classification Search ..... 439/152–160, 439/372, 64, 911, 326–328; 361/732, 747
See application file for complete search history.

(56) References Cited

U.S. PATENT DOCUMENTS 6,276,950 B1 8/2001 Yodogawa
6,494,729 B1 * 12/2002 Stathopoulos et al. ..... 439/160
7,172,441 B2 * 2/2007 Schlack ..... 439/152
7,284,997 B2 * 10/2007 Joist ..... 439/157

FOREIGN PATENT DOCUMENTS

CN 1221997 7/1999
CN 2821916 Y 9/2006

* cited by examiner

*Primary Examiner*—Edwin A. Leon
(74) *Attorney, Agent, or Firm*—Morris Manning Martin LLP; Tim Tingkang Xia, Esq.

(57) ABSTRACT

The invention relates to an electrical connector for inserting an electrical card in, and two side-ends of the electrical card respectively include at least one notch. The electrical connector includes an insulating body, a plurality of conducting terminals, a push-out device, and an elastic body. A top of the insulating body includes a slot and multiple accommodation chases along at least one side of the slot. The conducting terminals are disposed in the accommodation chases. The push-out device is pivotally engaged with a side-end of the insulating body, and includes a clasp part for clasping the notch of one of the side-ends of the electrical card. The elastic body is disposed on another side-end of the insulating body, and includes a main part, a fixing part for positioning the elastic body, and a buckle part for correspondingly buckling the notch of the other side-end of the electrical card.

20 Claims, 15 Drawing Sheets

ELECTRICAL CONNECTOR

BACKGROUND OF THE INVENTION

1. Field of the Invention

The invention relates to an electrical connector.

2. Description of the Prior Art

So far, an insulating body of an electrical connector which is disposed on a motherboard and used for connecting a memory card has an inserting slot for inserting the memory card in. Two side-ends of the insulating body of the electrical connector respectively have a movable push-out device. However, a user needs to operate the two push-out devices of the electrical connector to pull or inert the memory card. Therefore, the operation needs more space for both hands, and the electrical connector needs more operation space in a horizontal direction. In general, an electrical connector for a display card is disposed perpendicular to the electrical connector for the memory card, so an end of the electrical connector for the display card is close to an end of the electrical connector for the memory card. Besides, the length of the display card is usually longer than the electrical connector for the display card, so a space between the display card and the electrical connector for the memory card is small. For the preceding reasons, a user does not easily insert the memory card into the electrical connector.

In order to overcome the disadvantage described above, a conventional and moveable push-out device is disposed on one of two side-ends of an insulating body of an electrical connector, and a fixing clasp is integrated with the other side-end of the insulating body, which is disclosed in CN application No. 98125794.1. Compared with the movable push-out device, the fixing clasp of the electrical connector does not need to be manually operated, so the operation space for the electrical connector can be reduced. However, the flexibility of plastic is small, so the fixing clasp can not provide enough operation space for the memory card when it is pulled from or inserted into the electrical connector. And the memory card can not be easily inserted in or pulled from the electrical connector. Besides, the fixing clasp does not have a structure for clasping the memory card, so one side-end of the memory card can not be fixed firmly by the fixing clasp, and is easily warped or ejected upward. Moreover, when the memory card is inserted in the electrical connector, the memory card is easily damaged by a sharp part of the fixing clasp.

Another method to overcome the aforesaid disadvantages is that, a conventional and movable push-out device is disposed on one of the side-ends of the insulating body of the electrical connector, and a guiding device is integrated with the other side-end of the insulating body, which is disclosed in U.S. Pat. No. 6,276,950. Compared with the push-out device, the guiding device reduces the operation space of the electrical connector in a horizontal direction. But, when the memory card is pulled out, a guiding arm of the guiding device merely contacts an edge of a side-end of the memory card. When the memory card is inserted in the electrical connector, the guiding arm does not contact the memory card. Therefore, one side-end of the memory card can not be fixed firmly by the guiding device, and is easily warped or ejected upward.

In addition, a pivot device is provided to correct the aforesaid disadvantages. Namely, a conventional and movable push-out device is disposed on one of the side-end of the insulating body of the electrical connector, and a pivot device is disposed on the other side-end of the insulating body, which is disclosed in CN application No. 200520111747.0. Compared with the push-out device, the pivot device reduces the operation space of the electrical connector. Although a memory card can be easily inserted into the electrical connector, the memory card needs to be modified for the electrical connector, and the modified memory card is not a general type. Besides, the memory card can not be effectively clasped by the pivot device. Namely, one side-end of the memory card can not be effectively positioned and is easily warped or ejected upward, so the memory card can not be firmly fixed on the electrical connector and can not has a good electrical connection.

Therefore, need to design a new electrical connector to solve the aforesaid problems.

SUMMARY OF THE INVENTION

A scope of the invention is to provide an electrical connector with less operation space in a horizontal direction, and an electrical card can be firmly retained in and easily inserted into the electrical connector.

According to a first embodiment, the electrical connector of the invention is used for inserting an electrical card in, and two side-ends of the electrical card respectively include at least one notch. The electrical connector includes an insulating body, a plurality of conducting terminals, a push-out device, and an elastic body. A top of the insulating body includes a slot for inserting the electrical card in and includes a plurality of accommodation chases along at least one side of the slot. The conducting terminals are disposed in the accommodation chases. The push-out device is pivotally engaged with a side-end of the insulating body, and includes a clasp part for clasping the notch of one of the side-ends of the electrical card. The elastic body is disposed on another side-end of the insulating body, and includes a main part, a fixing part for positioning the elastic body, and a buckle part for correspondingly buckling the notch of the other side-end of the electrical card. The main part can be posited at a first position or alternatively at a second position when the main part is deformed away from the insulating body. When the electrical card is inserted in the slot, the other side-end of the electrical card presses the main part of the elastic body first so that the main part is pushed to the second position. When the electrical card is inserted in the slot completely, the buckle part of the elastic body correspondingly buckles the notch of the other side-end of the electrical card so that the main part returns to the first position.

In the first embodiment, by means of the elastic body, when the electrical card is inserted in the slot, the other side-end of the electrical card presses the main part of the elastic body, and the main part is pushed to the second position. When the electrical card is inserted in the slot completely, the buckle part buckles the notch of the other side-end of the electrical card so that the main part returns to the first position. Alternatively, the elastic body does not need to be manually operated, and the main part of the elastic body can be at the first position or at the second position according to a downward pressing force of the electrical card. Therefore, the electrical card can be perpendicularly and easily inserted in the slot of the electrical connector, and the operation space for the electrical connector in a horizontal direction can be reduced. Besides, after the electrical card is inserted in the electrical connector, the clasp part of the push-out device clasps the notch of one of side-ends of the electrical card, and the buckle part of the elastic body correspondingly buckles the notch of the other side-end of the electrical card. Therefore, two side-ends of the electrical card can be effectively posited and firmly fixed, and are not warped or ejected upward to detach from the push-out device and the elastic body. Further, the electrical card can be inserted firmly in the electrical connector.

According to a second embodiment, the electrical connector of the invention is used for inserting an electrical card in, and two side-ends of the electrical card respectively include at least one notch. The electrical connector includes an insulating body, a plurality of conducting terminals, a push-out device, and an elastic body. A top of the insulating body includes a slot for inserting the electrical card in, and includes a plurality of accommodation chases along at least one side of the slot. The conducting terminals are disposed in the accommodation chases. The push-out device is pivotally engaged with a side-end of the insulating body, and includes a clasp part for clasping the notch of one of the side-ends of the electrical card. The elastic body is disposed on another side-end of the insulating body, and includes a main part, a fixing part for positioning the elastic body, and a buckle part disposed on a top of an acceptance slot of the main part. The buckle part is engaged with the notch of the other side-end of the electrical card. Accordingly, when the electrical card is inserted in the slot, and the buckle part is engaged with the notch of the other side-end of the electrical card, the electrical card is partially inserted into the acceptance slot.

In the second embodiment, the buckle part is disposed on a top of an acceptance slot of the main part, and is engaged with the notch of the other side-end of the electrical card. Accordingly, when the electrical card is inserted in the slot, and the buckle part is engaged with the notch of the other side-end of the electrical card, the electrical card is partially inserted into the acceptance slot. Alternatively, the electrical card can be inserted in the slot of the electrical connector, and the buckle part can be engaged with the notch of the other side-end of the electrical card by a downward force without manually operating the elastic body. Accordingly, the electrical card can be perpendicularly and easily inserted in the slot of the electrical connector, and the operation space for the electrical connector in a horizontal direction can be reduced. Besides, after the electrical is inserted in the slot of the electrical connector, the clasp part of the push-out device clasps the notch of one of the side-ends of the electrical card. Moreover, the buckle part of the elastic body correspondingly buckles the notch of the other side-end of the electrical card, and the electrical card is partially inserted in the acceptance slot of the elastic body. Therefore, two side-ends of the electrical card can be effectively posited and firmly fixed, and are not warped or ejected upward to detach from the push-out device and the elastic body. Further, the electrical card can be inserted firmly in the electrical connector.

According to a third embodiment, the electrical connector of the invention is used for inserting an electrical card in, and two side-ends of the electrical card respectively include at least one notch. The electrical connector includes an insulating body, a plurality of conducting terminals, a push-out device, and an elastic body. A top of the insulating body includes a slot for inserting the electrical card in and includes a plurality of accommodation chases along at least one side of the slot. The conducting terminals are disposed in the accommodation chases. The push-out device is pivotally engaged with a side-end of the insulating body, and includes a clasp part for clasping the notch of one of the side-ends of the electrical card. The elastic body is disposed on another side-end of the insulating body, and includes a main part, a fixing part for positioning the elastic body, and a buckle part correspondingly engaged with the notch of the other side-end of the electrical card. A bottom of the buckle part includes a support surface. Accordingly, when the electrical card is inserted in the slot, and the buckle part is engaged with the notch of the other side-end of the electrical card, the support surface contacts a bottom edge of the notch.

In the third embodiment, the elastic body is disposed on another side-end of the insulating body. When the electrical card is inserted in the slot of the insulating body, the main part of the elastic body can be deformed flexibly by means of a downward force of the electrical card without manually operating. Further, the buckle part can be engaged with the notch of the other side-end of the electrical card. Accordingly, the electrical card can be perpendicularly and easily inserted in the slot of the electrical connector, and the operation space for the electrical connector in a horizontal direction can be reduced. Besides, after the electrical card is inserted in the slot of the electrical connector, the clasp part of the push-out device clasps the notch of one of the side-ends of the electrical card, and the support surface contacts the bottom edge of the notch. Therefore, two side-ends of the electrical card can be effectively posited and firmly fixed, and are not warped or ejected upward to detach from the push-out device and the elastic body. Further, the electrical card can be inserted firmly in the electrical connector.

BRIEF DESCRIPTION OF THE APPENDED DRAWINGS

DETAILED DESCRIPTION OF THE INVENTION

The advantage and spirit of the invention may be understood by the following recitations together with the appended drawings.

Figure 1:
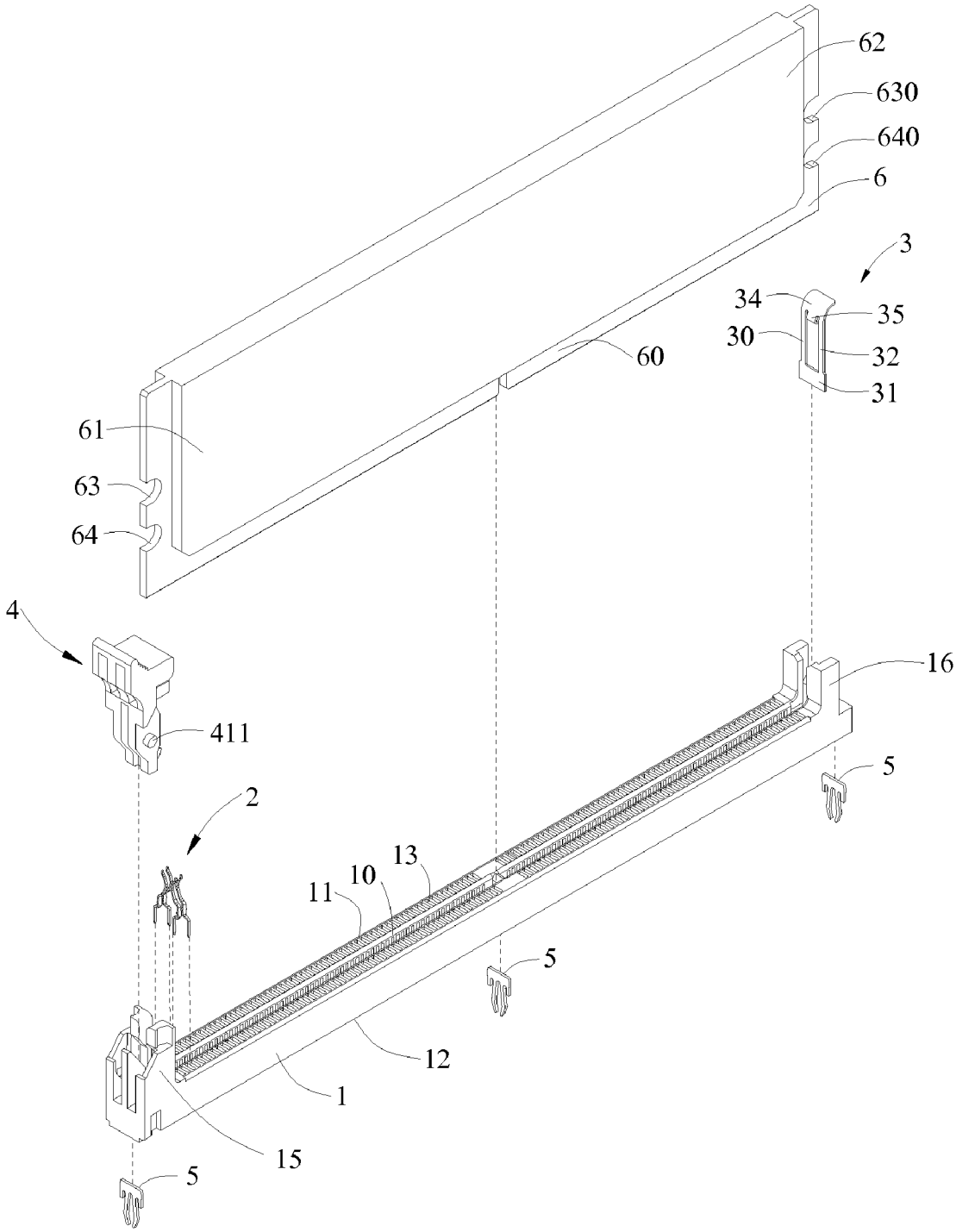
FIG. 1 is an exploded view of an electrical connector of the invention.
Figure 2:
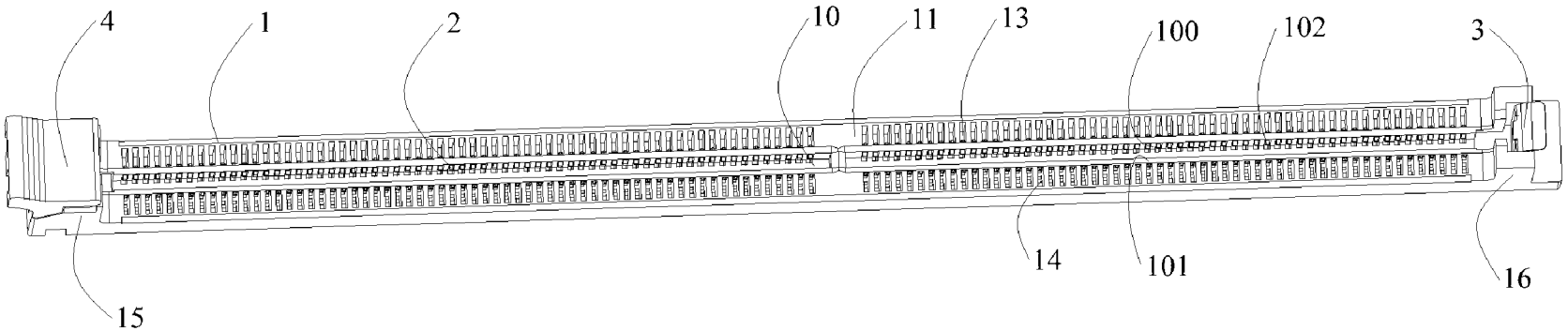
FIG. 2 is an assembly view of the electrical connector shown in FIG. 1.
Figure 3:
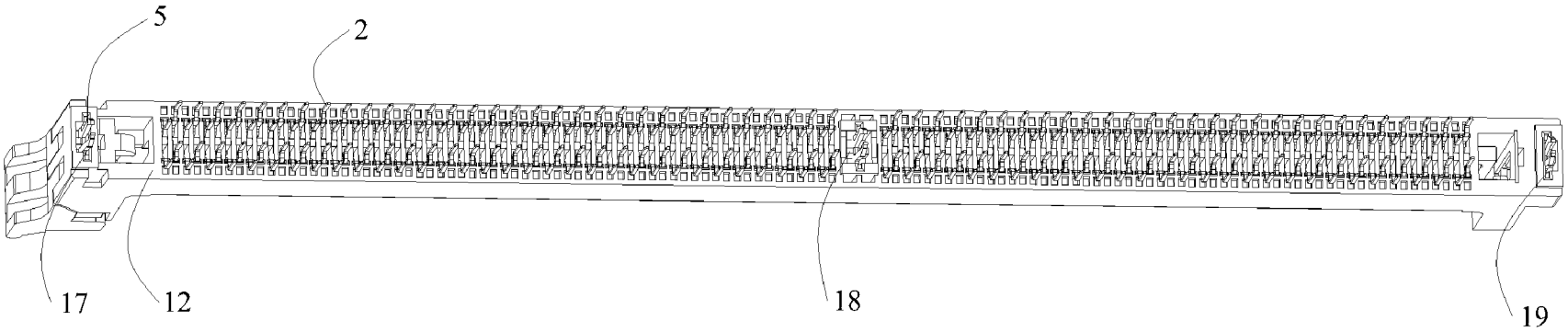
FIG. 3 illustrates the electrical connector shown in FIG. 2 in another view angle.

Please refer to FIG. 1 through FIG. 3. The electrical card 6 is electrically connected to a circuit board (not shown) via an electrical connector of the invention. The electrical connector of the invention includes an insulating body 1, a plurality of conducting terminals 2, an elastic body 3 disposed on the insulating body 1, a push-out device 4, and two fixing devices 5 for fixing the insulating body 1 onto the circuit board.

A slot 10 is used for inserting an electrical card in, and is disposed along a longitudinal direction of the insulating body 1. The insulating body 1 thereon defines a top surface 11 and a bottom surface 12 opposite to the top surface 11. There are multiple short slots 13 disposed on the top surface 11 and arranged on two sides of the slot 10. Two side-walls 100 and 101 of the slot 10 respectively include multiple holes 102. The hole 102 communicates with the short slot 13 to form an accommodation slot 14. The accommodation slot 14 penetrates the bottom surface 12 of the insulating body 1 and communicates with the slot 10. The accommodation slot 14 is used for accommodating the conducting terminal 2.

The insulating body 1 includes a first side-end and a second side-end opposite to the first side-end. The first side-end and the second side-end respectively include a first tower frame 15 and a second tower frame 16. The first tower frame 15 and the second tower frame 16 are integrated with the insulating body 1, and the first tower frame 15 is higher than the second tower frame 16.

The bottom surface 12 of the insulating body 1 includes concave slots 17, 18, and 19 disposed at the two side-ends and the middle of the insulating body 1. The concave slots are respectively used for receiving a fixing device 5, and the fixing device 5 can fix the insulating body 1 onto the circuit board (not shown).

Figure 4:
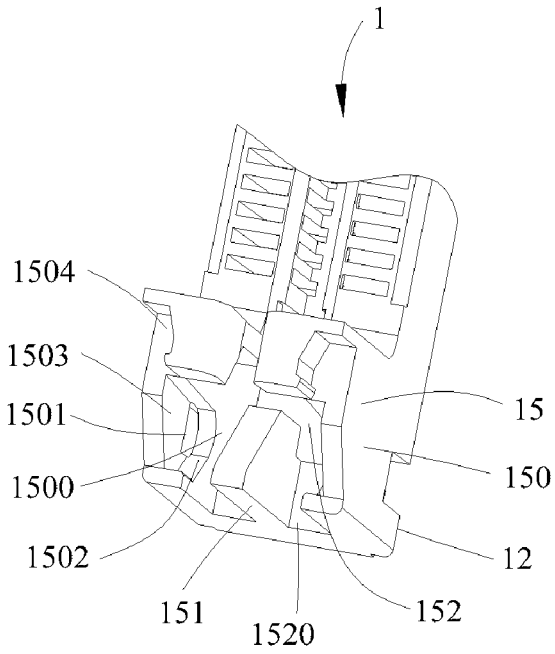
FIG. 4 is a local schematic diagram illustrating one of the side-ends of the insulating body of the electrical connector shown in FIG. 1.
Figure 5:
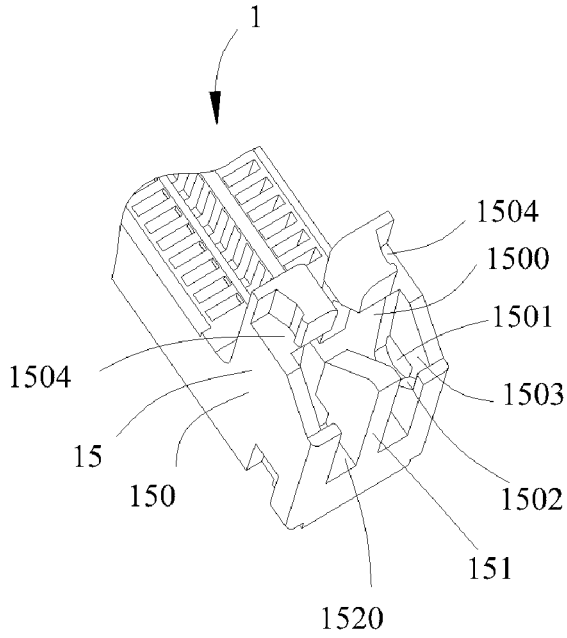
FIG. 5 is a local schematic diagram illustrating the side-end of the insulating body shown in FIG. 4 in another view angle.

Please refer to FIG. 4 and FIG. 5, the first tower frame 15 includes two side-plates 150 facing to each other and a middle pillar 151 disposed between the two side-plates 150. An inner wall 1500 of the side-plate 150 includes an engagement hole 1501, and a groove 152 is disposed between two side-plates 150 and penetrates the bottom surface 12 of the insulating body 1. Two sides of the middle pillar 151 respectively have a guiding slot 1520, and the guiding slots 1520 communicate with the groove 152. A stepped wedge surface 1502 is formed on the inner wall 1500 of the side-plate 150 and is used for locating the push-out device 4. Another inner wall 1503 offsets from the inner wall 1500, and the engagement hole 1501 is formed on the inner wall 1503. Further, a clasp slot 1504 is disposed on the side-plate 150.

Figure 6:
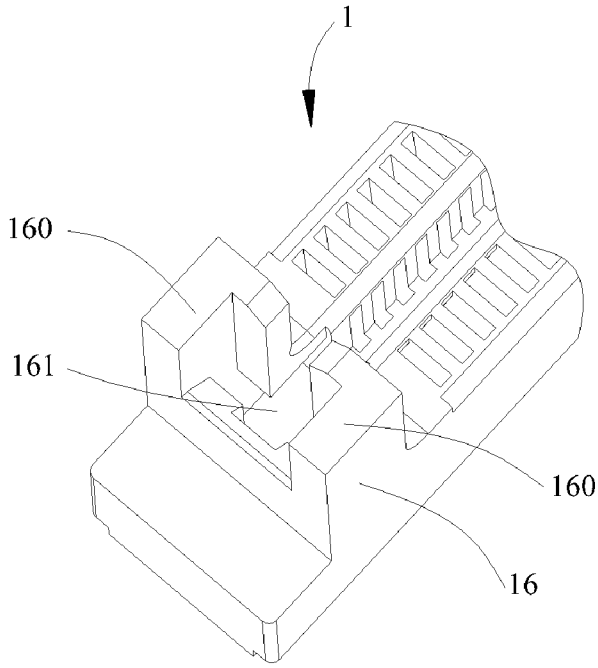
FIG. 6 is a local schematic diagram illustrating the other side-end of the insulating body of the electrical connector shown in FIG. 1.
Figure 7:
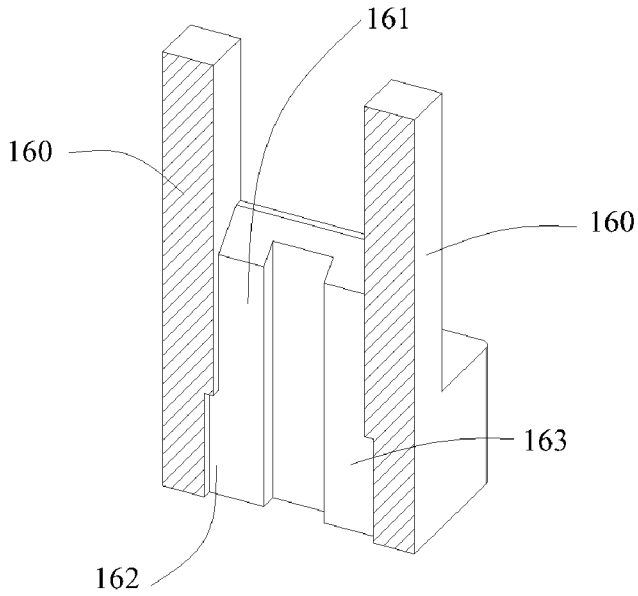
FIG. 7 is a local cross-section of the other side-end of the insulating body shown in FIG. 6.

Please refer to FIG. 6 and FIG. 7. The second tower frame 16 includes two side-plates 160. A first through hole 161 is formed between the two side-plates 160, and penetrates the bottom-surface 12 of the insulating body 1. The first through hole 161 further includes a second through hole 162 communicating with the first through hole 161, and the diameter of the second through hole 162 is larger than the diameter of the first through hole 161. The second tower frame 16 further includes a top-plate 163, and two side-plates 160 respectively connect to and perpendicular to the top-plate 163.

Figure 8:
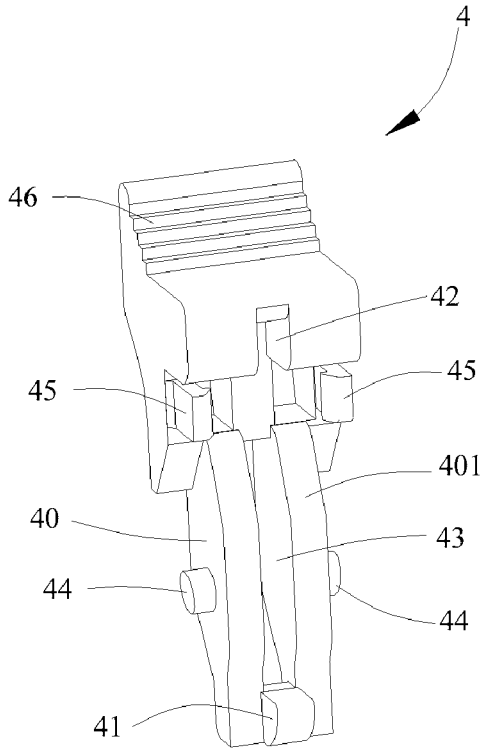
FIG. 8 is a stereogram illustrating the push-out device of the electrical connector shown in FIG. 1.
Figure 9:
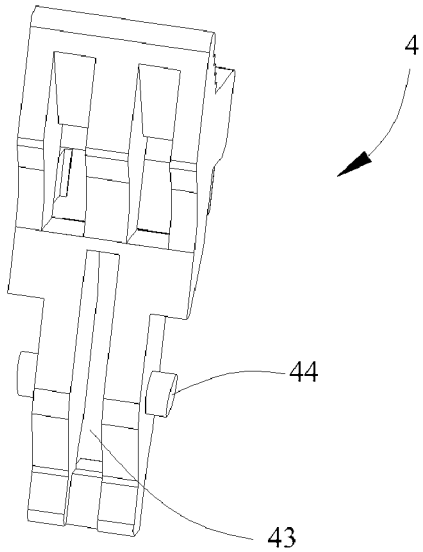
FIG. 9 is a stereogram illustrating the push-out device shown in FIG. 8 in another view angle.
Figure 10:
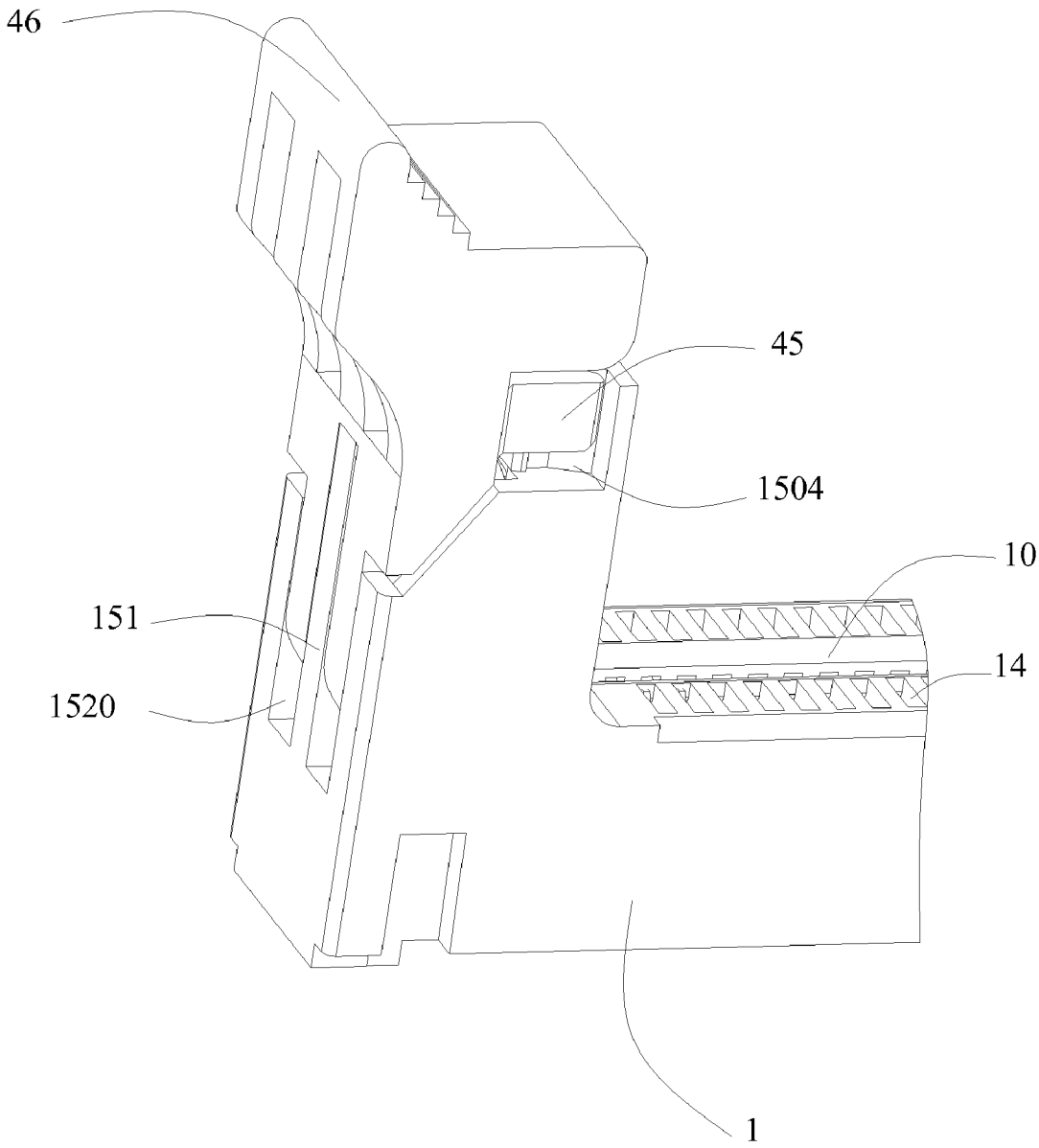
FIG. 10 is a local schematic diagram illustrating the push-out device disposed in the insulating body.

Please refer to FIG. 8 through FIG. 10, the push-out device 4 is pivotally engaged with the first tower frame 15 of the insulating body 1, and includes a main part 40, a push part 41, and a clasp part 42. The push part 41 is disposed below the main part 40, and is used for pushing the electrical card 6 out of the slot 10 of the insulating body 1. The clasp part 42 is disposed above the main part 40, and is used for clasping one side-end of the electrical card 6.

The main part 40 thereon includes two side parts 401 facing to each other, and the side parts 401 are respectively disposed in the guiding slot 1520 of the first tower frame 15. A slot hole 43 is formed between the two side-parts 401, and matches the middle pillar 151 of the insulating body 1.

The two side-plates 401 respectively include an engagement pillar 44 facing to each other. The engagement pillar 44 matches the engagement hole 1501 of the insulating body 1 and contacts the stepped wedge surface 1502. After the engagement pillars 44 are engaged with the engagement holes 1501, the push-out device 4 can rotate relative to the first tower frame 15 in certain angles.

Holding parts 45 are respectively disposed above the two side parts 401, and are disposed in the clasp slots 1504. The mutual fixing of the push-out device 4 and the first tower frame 15 can be completed via the engagement between the holding parts 45 and the clasp slots 1504. In addition, a trigger part 46 is disposed above the holding part 45. When the trigger part 46 is pressed outwardly, the push-out device 4 will rotate relative to the first tower frame 15 in certain angles.

Figure 11:
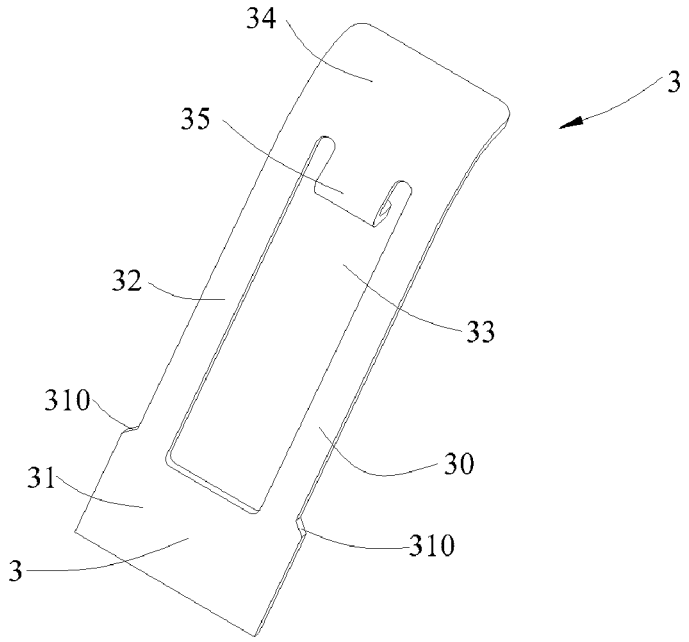
FIG. 11 is a stereogram illustrating the elastic body of the electrical connector shown in FIG. 1.
Figure 12:
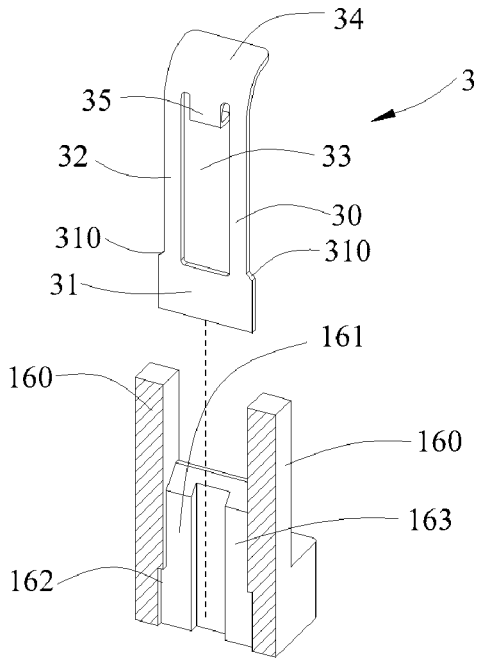
FIG. 12 is a stereogram illustrating an elastic body before being disposed in an insulating body.
Figure 13:
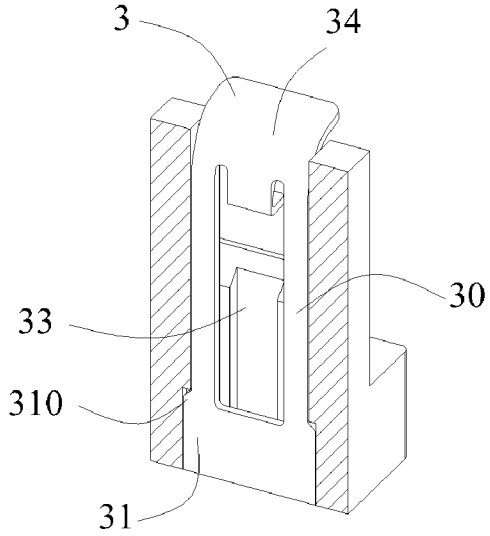
FIG. 13 is a stereogram illustrating an elastic body after being disposed in an insulating body.
Figure 14:
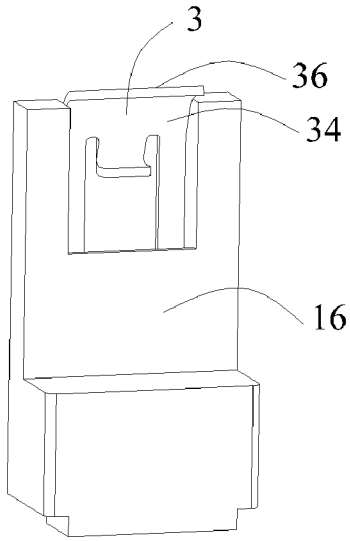
FIG. 14 is a stereogram illustrating an elastic body after being disposed in an insulating body in another view angle.
Figure 15:
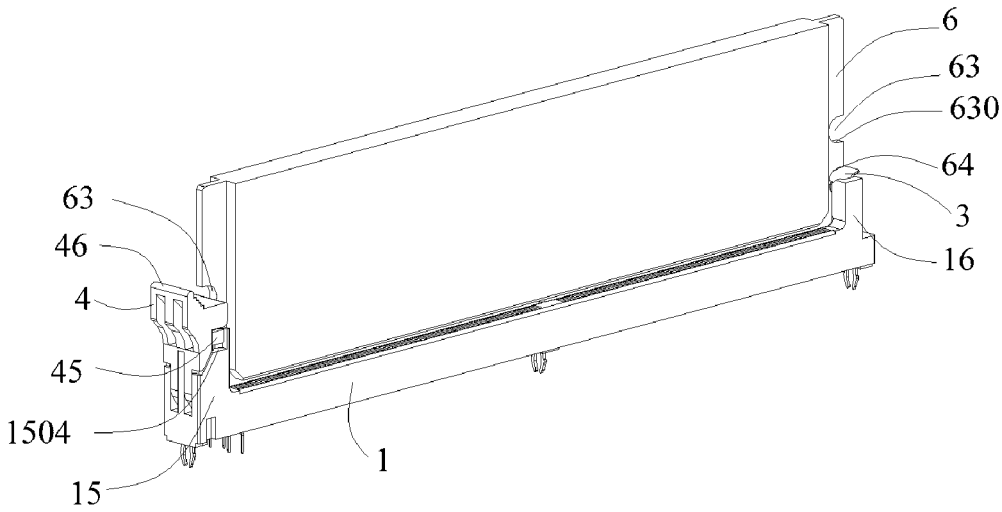
FIG. 15 illustrates an assembly view of an electrical connector of the invention and an electrical card.
Figure 16:
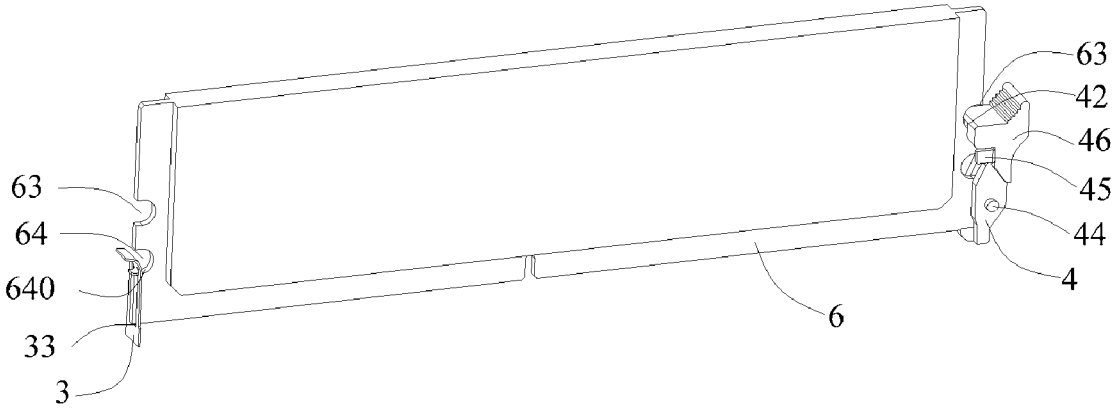
FIG. 16 is a stereogram illustrating an elastic body and a push-out device matching an electrical card.

Please refer to FIG. 11 through FIG. 14. The elastic body 3 includes a main part and a fixing part 31 for positioning the elastic body 3 in the second tower frame 16, as shown in FIG. 13. Two sides of the fixing part 31 respectively include a protrusion part 310. When the elastic body 3 is disposed in the first through hole 161 of the second tower frame 16, the protrusion parts 310 are respectively locked in the second through holes 162 to fix the elastic body 3 to the insulating body 1.

The main part 30 includes two elastic arms 32 parallel to each other and extending upward from the fixing part 31. The fixing part 31 can be fixed not only on the insulating body 1 but also on the circuit board (not shown).

Figure 18:
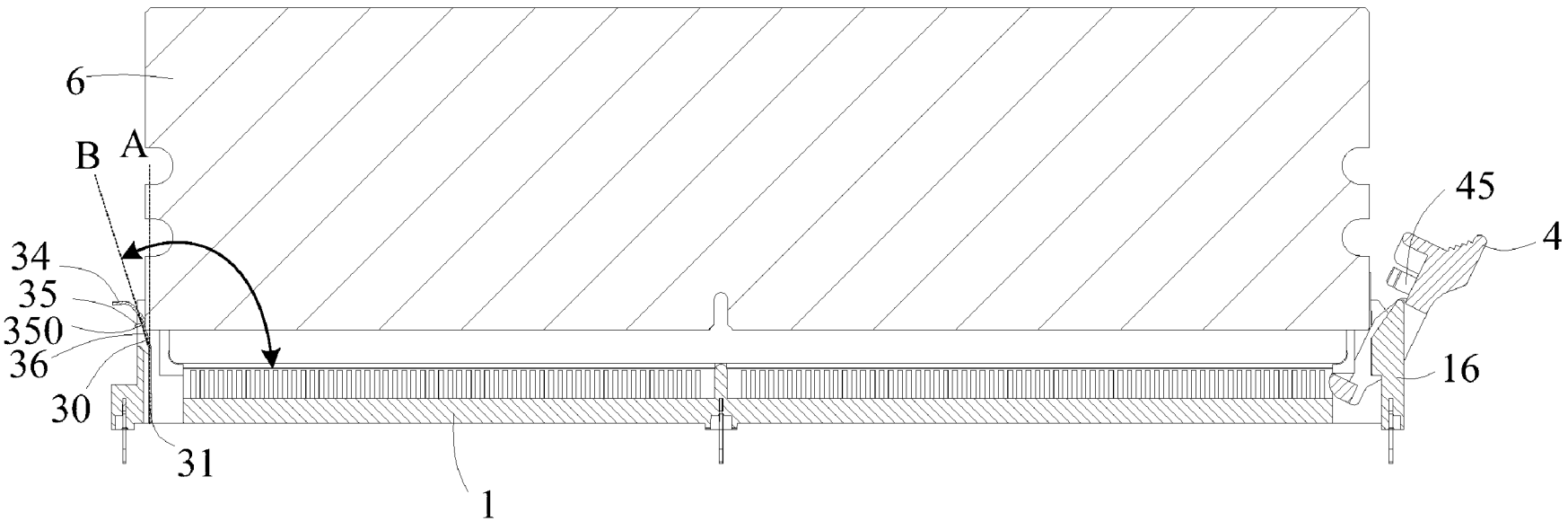
FIG. 18 is a cross-section illustrating the electrical card inserted in the insulating body shown in FIG. 17.
Figure 19:
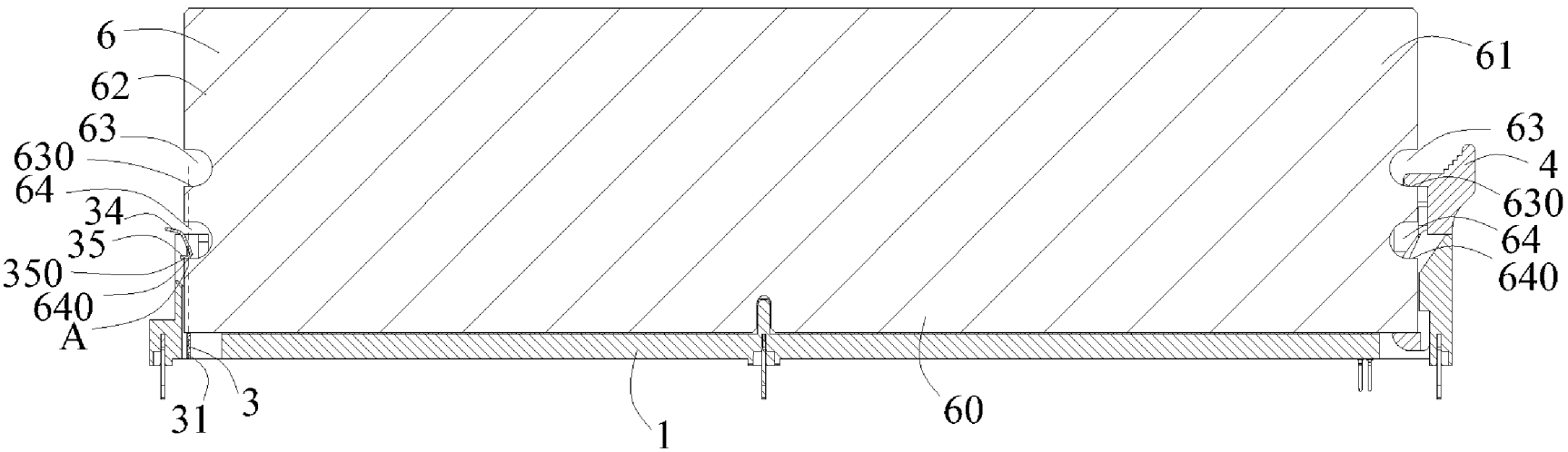
FIG. 19 is a cross-section illustrating the electrical card after being inserted in the insulating body shown in FIG. 18.

The main part 30 includes an acceptance slot 33 between the two elastic arms 32, and the acceptance slot 33 is in a rectangle shape. In this embodiment, the acceptance slot 33 is used for partially accepting the electrical card 6. In other embodiments, the main part 30 can include only one elastic arm 32, and the acceptance slot 33 is disposed on one side of the main part 30. Of course, the acceptance slot 33 can be in other suitable shapes, and these shapes will not be described here. Therefore, the electrical card 6 can be partially inserted into the acceptance slot 33, and the acceptance slot 33 provides a moving space for the electrical card 6. Furthermore, a regular electrical card 6 (as shown in FIGS. 18 and 19) can be utilized, and the electrical card 6 can be locked firmly.

The elastic body 3 further includes a guiding part 34, and the guiding part 34 extends upward from the elastic arms 32 of the main part 30. The guiding part 34 is an arc-shape structure. During inserting the electrical card 6 into the slot 10 of the insulating body 1, the guiding part 34 provides a guiding function.

The elastic body 3 further includes a bended buckle part 35 extending into the acceptance slot 33 and extending downwardly from the guiding part 34. As shown in FIG. 11 and FIG. 12, the buckle part 35 actually is an elastic piece extending from a top edge of the acceptance slot 33 toward the acceptance slot. A bottom of the buckle part 35 includes a support surface 350.

After the elastic body 3 is disposed in the first through hole 161 of the second tower frame 16, a free tail 36 of the guiding part 34 exceeds the top end of the second tower frame 16. The inner sides of the two side-plates 160 of the second tower frame 16 clip the two side-ends of the elastic body 3 to limit the electrical card 6 to move left or right (namely, limit the electrical card 6 to move along a direction perpendicular to the longitudinal direction of the insulating body 1). Besides, the second tower frame 16 includes a limit part (namely, the top-plate 163) correspondingly to the outside of the main part 30 of the elastic body 3. The top plate 163 (the limit part) perpendicular to the two side-plates 160 is disposed the outside of the main part 30 of the elastic body 3 to limit the elastic body 3 to move along the longitudinal direction of the insulating body 1.

Please refer to FIG. 15 through FIG. 19. In assembly, at first, the fixing devices are respectively installed and fixed in the concave slots 17, 18, and 19 of the bottom surface 12 of the insulating body 1, as shown in FIG. 3; afterward, the conducting terminals 2 are installed and fixed in the accommodation slots 14 of the insulating body 1, as shown in FIG. 2; then, the push-out device 4 and the elastic body 3 are respectively installed and fixed in the first tower frame 15 and the second tower frame 16 of the insulating body 1; at last, the assembled electrical connector is mounted on the circuit board (not shown).

Figure 17:
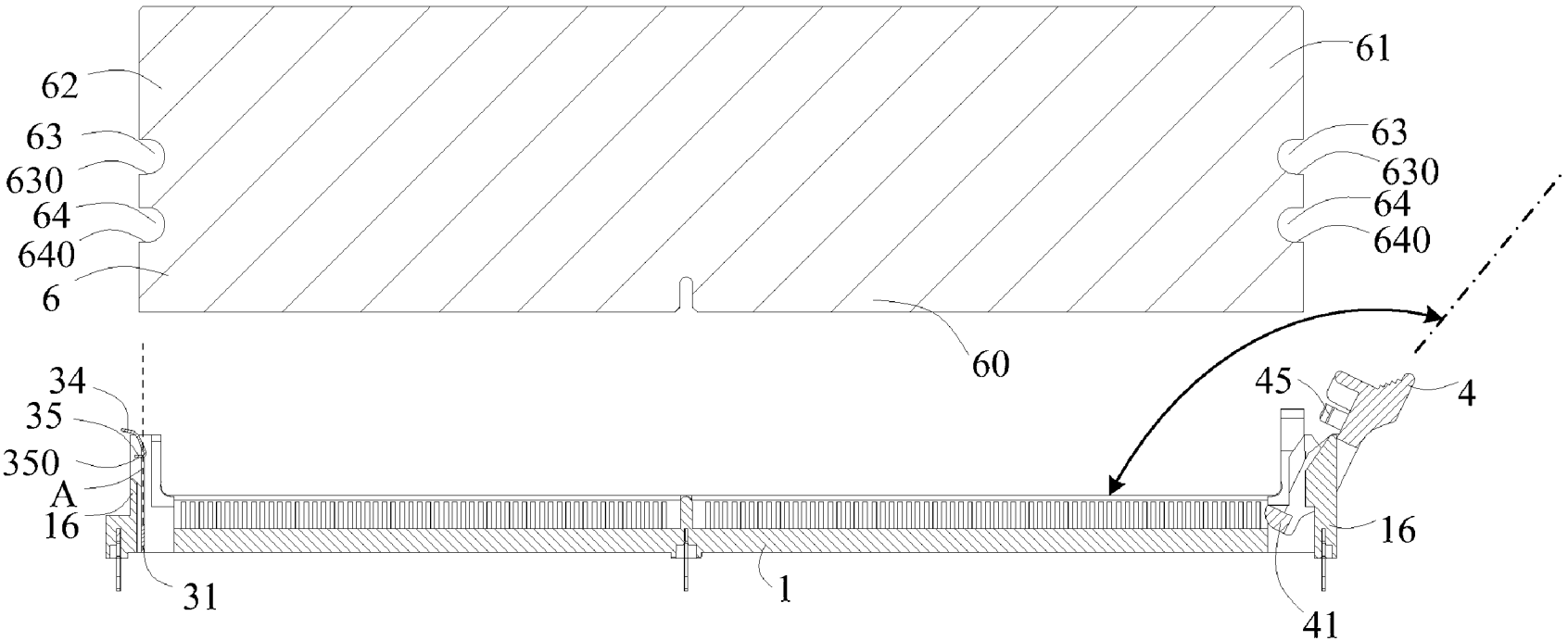
FIG. 17 is a cross-section illustrating an electrical card before being inserted in the insulating body.

Please refer to FIG. 1 and FIG. 17. The electrical card 6 includes a first side-end 61 and a second side-end 62 opposite to the first side-end 61. The two side-ends both include a first notch 63 and a second notch 64. A bottom edge of the first notch 63 includes a first clasp surface 630 facing upward, and a bottom edge of the second notch 64 includes a second clasp surface 640 facing upward. The first notch 63 is posited above the second notch 64. Besides, the electrical card 6 further includes a working part 60 inserted into the slot 10 of the electrical connector 1 and contacting the conducting terminals 2.

Before the electrical card 6 is inserted into the slot 10 of the insulating body 1, the push-out device 4 is disposed in the first tower frame 15 and perpendicular to the insulating body 1. The elastic body 3 is disposed in the second tower frame 16 and perpendicular to the insulating body 1. The main part 30 of the elastic body 3 is perpendicular to the insulating body 1, and alternatively, the main part 30 is posited at a first position A.

Before, the electrical card 6 begins to be inserted in the electrical connector 1, at first, the push-out device 4 is rotated outward in certain angles, and an obtuse angle is formed between the push-out device 4 and the insulating body 1, as shown in FIG. 17.

Afterward, the electrical card 6 is perpendicularly inserted into the slot 10 of the insulating body 1. When the electrical card 6 moves downwardly in certain distance, the second side-end 62 of the electrical card 6 contacts the guiding part 34 of the elastic body 3. Then, the electrical card 6 is guided by the guiding part 34 of the elastic body 3 to move downward unceasingly. During moving downward, the second side-end 62 of the electrical card 6 presses the elastic body 3. Meanwhile, because the elastic body 3 has certain flexibility, the elastic body 3 can be deformed in the longitudinal direction of the insulating body 1, and a top portion of the main part 30 deforms outward, and an obtuse angle is formed between the main part 30 and the insulating body 1. Therefore, the main part 30 is deformed outward and posited at a second position B, and a space for inserting the electrical card 6 in the slot 10 is provided so that the electrical card 6 can be inserted in a direction perpendicular to the insulating body 1, as shown in FIG. 18.

After the electrical card 6 is inserted in the slot 10 of the insulating body 1, the working part 60 of the electrical card 6 presses the bottom of the slot 10 of the electrical connector 1 and contacts the conducting terminals 2. Because the elastic body 3 has certain flexibility, the top portion of the main part 30 of the elastic body 3 returns to be vertical by its elastic force. Alternatively, the main part 30 returns to the first position A, and the support surface 350 of the bended buckle part 35 contacts the second clasp surface 640 of the second notch 64 of the second side-end 62 of the electrical card 6. The second clasp surface 640 of the electrical card 6 partially enters into the acceptance slot 33 of the elastic body 3 so as to prevent the second side-end 62 of the electrical card 6 from warping or ejecting upward. Then, the push-out device 4 disposed on the first tower frame 15 is rotated inward until the clasp part 42 clasping the first clasping surface 630 of the first notch 63 of the electrical card 6. Therefore, the first side-end 61 of the electrical card 6 is prevented from warping or ejecting upward, and two side-ends of the electrical card 6 can be effectively posited and fixed firmly, alternatively, the electrical card 6 can be firmly inserted in the electrical connector. Meanwhile, both the push-out device 4 and the elastic body 3 buckle the electrical card 6 and perpendicular to the insulating body 1, as shown in FIG. 19.

The method for pulling the electrical card 6 from the electrical connector includes the following steps. At first, the push-out device 4 is rotated outward and rotated in certain angles. The push part 41 of the push-out device 4 upwardly ejects the electrical card 6, so the first side-end 61 of the electrical card 6 is upwardly ejected from the slot 10 of the insulating body 1. Meanwhile, the second side-end 62 of the electrical card 6 outwardly presses the elastic body 3, because the elastic body 3 has certain flexibility, the top portion of the main part 30 is deformed and leaned outward, and an obtuse angle is formed between the main part 30 and the insulating body 1. Namely, the main part 30 of the elastic body 3 is pushed from the first position A to the second position B, and a space for pulling the electrical card 6 from the slot 10 is provided. At this time, the electrical card 6 can be manually pulled from the electrical connector (not shown). After the electrical card 6 is pulled out, the top portion of the main part 30 of the elastic body 3 returns to be vertical by its elastic force, and alternatively, the main part 30 returns to the first position A.

Through the deformation of the elastic body 3 along the longitudinal direction of the insulating body 1, the main part 30 of the elastic body 3 can move from the first position A to the second position B depending on the pressing force from the electrical card without manually operating the elastic body 3. In this case, the electrical card 6 can be inserted into the slot 10 of the electrical connector along the direction perpendicular to the insulating body 1 without operating the elastic body 3, and only to operate the push-out device 4, so the operation space of the electrical connector is reduced. Besides, after the electrical card 6 is inserted in the electrical connector, the clasp part 42 of the push-out device 4 clasps the notch 63 of the first side-end 61 of the electrical card 6. The buckle part 35 of the elastic body 3 is correspondingly engaged with the notch 64 of the second side-end 62 of the electrical card 6, and the second side-end 62 of the electrical card 6 is partially inserted in the accommodation slot 33. Therefore, two side-ends 61 and 62 of the electrical card 6 can be effectively posited and firmly fixed without warping or ejecting from the push-out device 4 and the elastic body 3.

Figure 20:
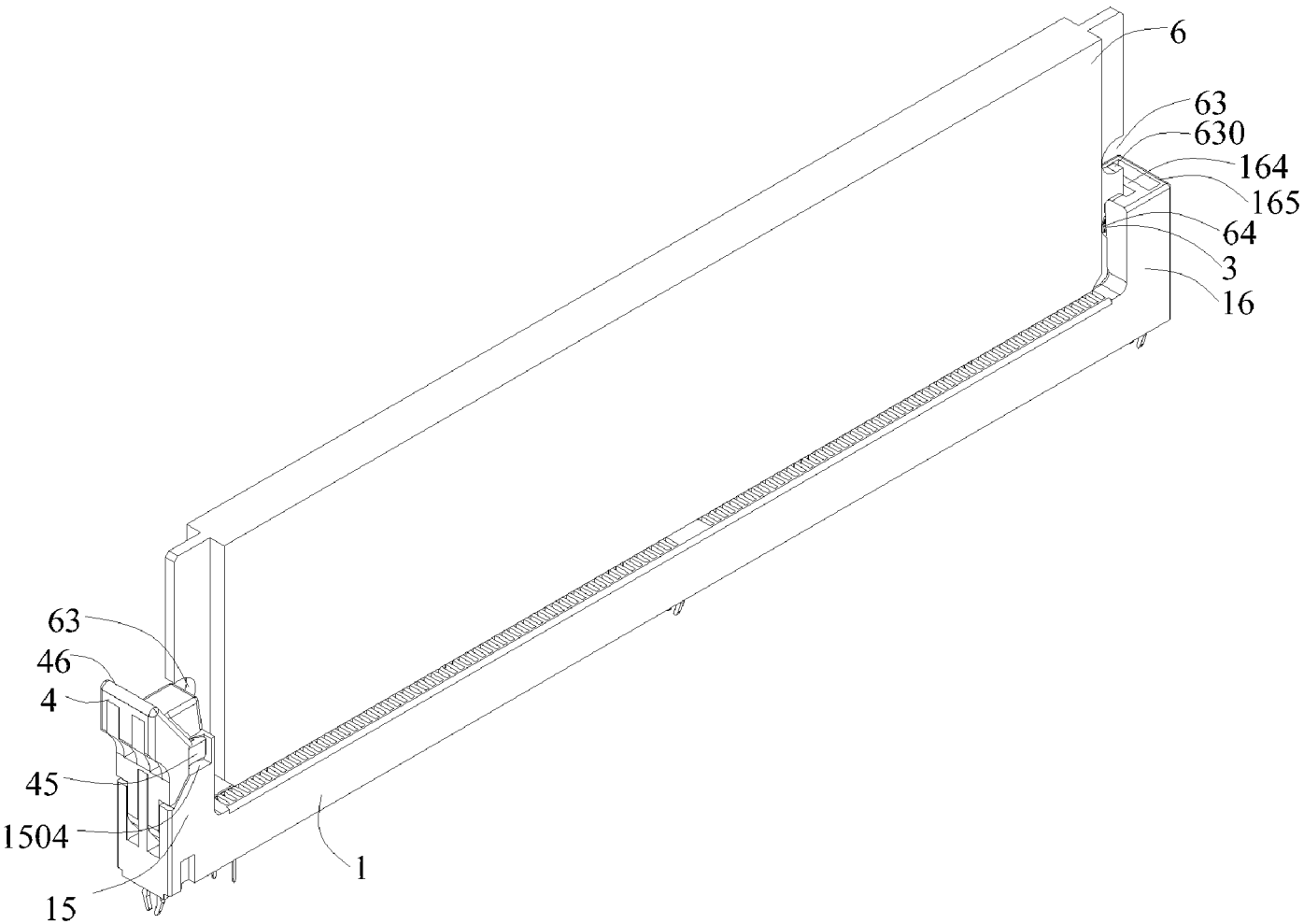
FIG. 20 is a stereogram illustrating an electrical card after being inserted in an electrical connector according to a second embodiment of the invention.
Figure 21:
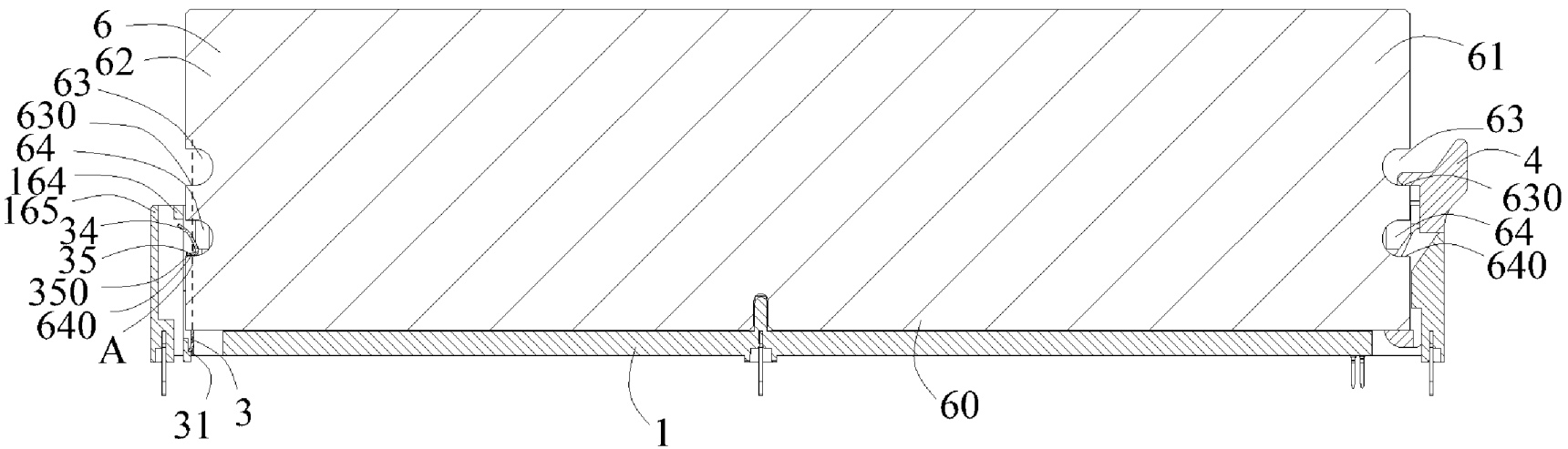
FIG. 21 is a cross-section illustrating the electrical card after being inserted in the electrical connector shown in FIG. 20.

Please refer to FIG. 20 and FIG. 21, and these figures show a second embodiment of an electrical connector of the invention. Compared with the first embodiment, the second tower frame 16 is higher than the elastic body 3. When the elastic body 3 is disposed in the first through hole 161 of the second tower frame 16, the free tail 36 of the guiding part 34 doesn't exceed the top end of the second tower frame 16. An inner stop 164 is disposed on the second tower frame 16 and is above the free tail 36 of the guiding part 34. An outer stop 164 is disposed on the second tower frame 16, and is away from the slot 10. The outer stop 165 connects with the ends of the side-plates, and the ends are away from the slot 10. When the electrical card 6 is inserted in the electrical connector, the inner stop 164 and the outer stop 165 can prevent the elastic body 3 from being moved by the user, and further a fool-proof function is provided. Besides, when then electrical card 6 is inserted or pulled, the inner stop 164 and the outer stop 165 can prevent the elastic body 3 from being overly pressed. The electrical connector in the second embodiment of the invention also can provide the same function as the electrical connector in the first embodiment of the invention, which will not be described here again.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An electrical connector for inserting an electrical card in, two side-ends of the electrical card respectively comprising at least one notch, the electrical connector comprising:

an insulating body, a top of the insulating body comprising a slot for inserting the electrical card in and a plurality of accommodation slots along at least one side of the slot;

a plurality of conducting terminals disposed in the accommodation slots;

a push-out device, pivotally engaged with a side-end of the insulating body, the push-out device comprising a clasp part for clasping the notch of one of the side-ends of the electrical card; and an elastic body disposed on another side-end of the insulating body, the elastic body comprising a main part which can be positioned at a first position or alternatively at a second position when the main part is deformed away from the insulating body, a fixing part for positioning the elastic body, and a buckle part for correspondingly buckling the notch of the other side-end of the electrical card;

wherein during inserting the electrical card into the slot, the other side-end of the electrical card presses the main part of the elastic body firstly so that the main part is pushed to the second position, and when the electrical card is inserted in the slot completely, the buckle part of the elastic body correspondingly buckles the notch of the other side-end of the electrical card so that the main part returns to the first position.

2. The electrical connector of claim 1, wherein the elastic body comprises a guiding part at a free tail thereof opposite to the fixing part, and during inserting the electrical card into the slot, the other side-end of the electrical card presses the guiding part.

3. The electrical connector of claim 1, wherein the slot is disposed along a longitudinal direction of the insulating body.

4. The electrical connector of claim 1, wherein the main part of the elastic body comprises an acceptance slot, and the buckle part is an elastic piece extending from a top edge of the acceptance slot toward the acceptance slot.

5. The electrical connector of claim 1, wherein a first tower frame and a second tower frame are respectively disposed on the two side-ends of the insulating body along the longitudinal direction of the insulating body, the push-out device is installed in the first tower frame, and the elastic body is installed in the second tower frame.

6. The electrical connector of claim 5, wherein the second tower frame comprises at least one through hole, two sides of the fixing part respectively comprise at least one protrusion part, and the protrusion parts are respectively locked in the through hole.

7. The electrical connector of claim 5, wherein the elastic body comprises a guiding part opposite to the fixing part, and a free tail of the guiding part exceeds the top portion of the second frame tower.

8. The electrical connector of claim 5, wherein the second tower frame comprises two side-plates respectively correspondingly to two sides of the main part of the elastic body, so as to limit the electrical card to move along a direction perpendicular to the longitudinal direction of the insulating body.

9. The electrical connector of claim 5, wherein the second tower frame comprises a limit part correspondingly to the outside of the main part of the elastic body, so as to limit the elastic body to move along the longitudinal direction of the insulating body.

10. The electrical connector of claim 5, wherein a top end of the second tower frame comprises an inner stop above the elastic body and an outer stop away from the slot.

11. An electrical connector for inserting an electrical card in, two side-ends of the electrical card respectively comprising at least one notch, and the electrical connector comprising:

an insulating body, a top of the insulating body comprising a slot for inserting the electrical card in and a plurality of accommodation slots along at least one side of the slot;

a plurality of conducting terminals disposed in the accommodation slots;

a push-out device pivotally engaged with a side-end of the insulating body, the push-out device comprising a clasp part for clasping the notch of one of the side-ends of the electrical card; and an elastic body disposed on another side-end of the insulating body, the elastic body comprising a main part, a fixing part for positioning the elastic body, and a buckle part extending from a top edge of an acceptance slot of the main part, the buckle part engaged with the notch of the other side-end of the electrical card;

wherein when the electrical card is inserted in the slot, and the buckle part is engaged with the notch of the other side-end of the electrical card, the electrical card is partially inserted into the acceptance slot.

12. The electrical connector of claim 11, wherein the buckle part is an elastic piece extending from a top of the acceptance slot toward the acceptance slot.

13. The electrical connector of claim 11, wherein the notch of the other side-end of the electrical card comprises a clasp surface facing upward, a bottom of the buckle part comprises a support surface, and when the electrical card is inserted in the slot, and the buckle part is engaged with the notch of the other side-end of the electrical card, the support surface contacts the clasp surface.

14. The electrical connector of claim 11, wherein the fixing part is located at lower end of the main part, and the elastic body comprises a guiding part at a free tail thereof opposite to the fixing part.

15. The electrical connector of claim 14, wherein the main part comprises two elastic arms parallel to each other, and the two elastic arms connect the fixing part and the guiding part, and the acceptance slot is formed between the two elastic arms.

16. An electrical connector for inserting an electrical card in, two side-ends of the electrical card respectively comprising at least one notch, the electrical connector comprising:

an insulating body, a top of the insulating body comprising a slot for inserting the electrical card in and a plurality of accommodation slots along at least one side of the slot;

a plurality of conducting terminals disposed in the accommodation chases;

a push-out device pivotally engaged with a side-end of the insulating body, the push-out device comprising a clasp part for clasping the notch of one of the side-ends of the electrical card; and an elastic body disposed on another side-end of the insulating body, the elastic body comprising a main part, a fixing part for positioning the elastic body, and a buckle part correspondingly engaged with the notch of the other side-end of the electrical card, a bottom of the buckle part comprising a support surface;

wherein when the electrical card is inserted in the slot, and the buckle part is engaged with the notch of the other side-end of the electrical card, the support surface contacts a bottom edge of the notch.

17. The electrical connector of claim 16, wherein the bottom edge of each of the notches of the electrical card comprises a clasp surface, and when the electrical card is inserted into the slot, and the buckle part is engaged with the notch of the other side-end of the electrical card, the support surface contacts the corresponding clasp surface.

18. The electrical connector of claim 16, wherein the fixing part is located at a lower end of the main part, and the elastic body comprises a guiding part at a free tail thereof opposite to the fixing part.

19. The electrical connector of claim 16, wherein the main part comprises an acceptance slot, and the buckle part extends from a top edge of the acceptance slot toward the acceptance slot.

20. The electrical connector of claim 19, wherein when the electrical card is inserted in the slot, and the buckle part is engaged with the notch of the other side-end of the electrical card, the electrical card is partially inserted in the acceptance slot.

* * * * *